United States Patent [19]

Furst

[11] 4,381,723

[45] May 3, 1983

[54] SUBMERSIBLE DRYDOCK

[75] Inventor: Jan Furst, St. Johns, Canada

[73] Assignee: Nordco Limited, St. Johns, Canada

[21] Appl. No.: 251,166

[22] Filed: Apr. 6, 1981

[51] Int. Cl.[3] ..... B63C 1/06

[52] U.S. Cl. ..... 114/45; 405/3

[58] Field of Search ..... 114/44–48; 405/3, 4, 200, 202

[56] References Cited

U.S. PATENT DOCUMENTS

| | | | |
|---|---|---|---|
| 2,550,823 | 5/1951 | King | 114/45 |
| 2,963,176 | 12/1960 | Smith | 405/3 X |
| 3,276,211 | 10/1966 | Drake | 114/45 X |
| 3,362,172 | 1/1968 | Rutter | 405/3 |
| 3,951,087 | 4/1976 | Carson | 114/45 |
| 3,967,570 | 7/1976 | Bradfield | 114/45 |
| 4,149,469 | 4/1979 | Bigler | 114/44 |

*Primary Examiner*—Sherman D. Basinger
*Attorney, Agent, or Firm*—Fetherstonhaugh & Co.

[57] ABSTRACT

The submersible drydock system of the present invention is one in which the buoyancy of the docking platform is altered to effect raising and lowering thereof. The submersible dock comprises a submersible platform having a buoyancy chamber formed therein. Foundations are located below the platform and a parallelogram linkage system interconnects the platform and the foundation. The parallelogram linkage system is operable to retain the platform in the generally horizontal plane in all positions during raising and lowering of the platform. A buoyancy control system is provided which communicates with the buoyancy chamber to vary the amount of air within the chamber to effect raising and lowering of the platform relative to the foundation. Preferably, the buoyancy chamber is in the form of a buoyancy cavity formed on the underside of the platform, the buoyancy control consisting of a source of air having a discharge outlet submerged in the body of water and disposed below the platform whereby air may be discharged to pass through the body of water and to be accumulated in the buoyancy cavity thereby to increase the buoyancy of the platform.

2 Claims, 6 Drawing Figures

SUBMERSIBLE DRYDOCK

This invention relates to drydock systems. In particular, this invention relates to a submersible drydock system in which the buoyancy of the docking platform is altered to effect raising and lowering.

There are four conventional ways to drydock a ship. One method is to apply a graving dock wherein a ship is floated into a water-tight basin which can be closed off from the remainder of the body of water by a water-tight gate. The water is, then, pumped out of the basin leaving the ship dry in the dock. The second method is by means of a floating drydock which is generally a U-shaped or L-shaped pontoon which can be sunk with only the top of the vertical arms of the U or L extending above the water. The ship is, then, floated over the bottom of the pontoon. The water is, then, pumped out of the pontoon to make the pontoon buoyant to lift the ship out of the water. The vertical sidewalls of the pontoon are required to give the system stability during lifting and sinking of the pontoon.

Thirdly, the ship can be hauled out of the sea by means of a marine railway, which is a carriage on wheels, running on rails on a slope from the water on to the beach.

In all these systems, repair of the ship is carried out while the ship is resting on the drydocking device. Consequently, the device is occupied for the duration of that part of the repair jobs where the ship has to be dry.

The fourth system, is the so called Syncrolift. In this system, the ship is lifted out of the water on a platform, which can be hoisted up and lowered down by means of a number of winches located on piers on both sides of the platform.

The big advantage of the Syncrolift system is that the ships can be lifted free out of the water on level with the adjacent land, independent of tide and ebb.

It is an object of the present invention to overcome the difficulties of the prior art described above by providing a submersible drydock which has a submersible platform the buoyancy of which may be controlled such that the buoyancy of the platform is used to regulate the raising and lowering of the platform during the docking operation.

SUMMARY OF INVENTION

According to one aspect of the present invention, a submersible drydock comprises a shore-based stationary dock, a submersible platform, foundation means underlying the platform and guide means for guiding the platform between a raised position and a lowered position, buoyancy control means and means for securing the platform against movement with respect to the shore-based stationary dock. The buoyancy platform has a buoyancy cavity formed in its underside which opens downwardly. A vent is provided which is capable of opening and closing in order to maintain the cavity as an airtight cavity or to vent the cavity to permit the platform to submerge. The guide means is in the form of a parallelogram linkage system which interconnects the platform and the foundation. The parallelogram linkage system is arranged to be positioned overtop, dead centre when the platform is in the raised position, whereby a loss of buoyancy in the platform would result in movement of the platform to a position in which the front end thereof bears against the outside wall of the stationary dock, thereby preventing significant lowering of the platform.

PREFERRED EMBODIMENT

The invention will be more clearly understood after reference to the following detailed specification read in conjunction with the drawings wherein.

Figure 1:
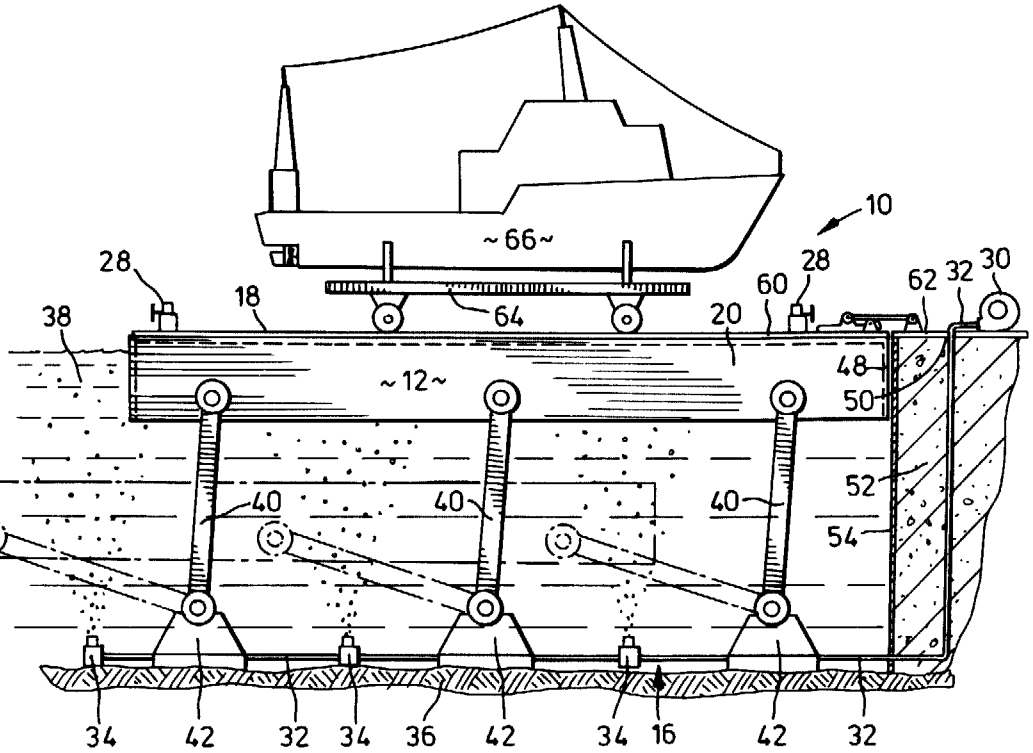
FIG. 1 is a side view of a drydock system constructed in accordance with an embodiment of the present invention.
Figure 2:
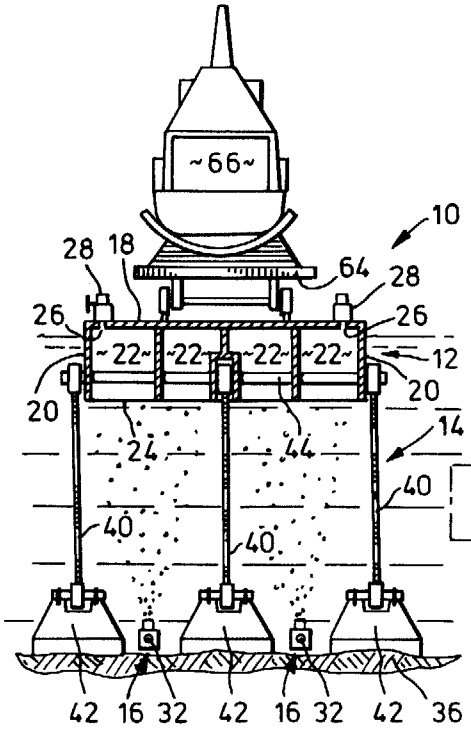
FIG. 2 is a sectional end view along the line 2—2 of FIG. 1.

With reference to FIGS. 1 and 2 of the drawings, reference numeral 10 refers generally to a drydock system constructed in accordance with an embodiment of the present invention. The drydock system 10 comprises a submersible platform generally identified by the reference numeral 12, guide means 14 for guiding the platform during raising and lowering thereof and a buoyancy control system generally identified by the reference numeral 16.

The submersible platform 12 has a deck portion 18 and a skirt portion 20 which extends downwardly from the side edge of the deck portion 18 to form a buoyancy cavity 22 in the underside 24 of the platform. Vent passages 26 open through the deck 18 into the buoyancy cavity 22 and vent valves 28 are provided in each vent passage 26 which are operable to open to vent the buoyancy cavity 22 and to close to make the cavity 22 airtight. The cavity 22 is open at its lower end so that air may be admitted to the cavity from below the platform.

The buoyancy control means 16 comprises an air pressure pump 30 which pumps air through a pair of conduits 32 and a plurality of discharge nozzles 34. The nozzles 34 are located at spaced intervals along the conduits 32 and rest on the bed 36 of the body of water 38. The discharge nozzles 34 are arranged below the platform 12 so that air may be discharged therefrom to pass upwardly through the body of water 38 to enter the buoyancy cavity 22 to displace water therefrom and, thereby, increase the buoyancy of the platform.

The guide means 14 serves to guide the platform along a predetermined path and to maintain the platform in a substantial horizontal plane as it is raised and lowered. Guide means comprises a plurality of link arms 40 each of which have a lower end pivotally mounted in a foundation member 42 which is located on the bed 36 of the body of water in a conventional manner so as to provide a stable foundation. The upper ends of the link arms 40 are pivotally connected to shafts 44 which are supported at opposite ends by the skirt portion 20.

The link arms 40 are proportioned and the foundation members 42 are positioned such that, when the deck 18 is substantially level with the horizontal upper face 50 of the shore-based stationary dock 52 and the front end 48 of the platform is disposed closely adjacent the outer sidewall 54 of the stationary dock 52, the link arms 40 are located in a position slightly over top dead centre so as to add stability to the platform within the docking configuration.

Figure 4:
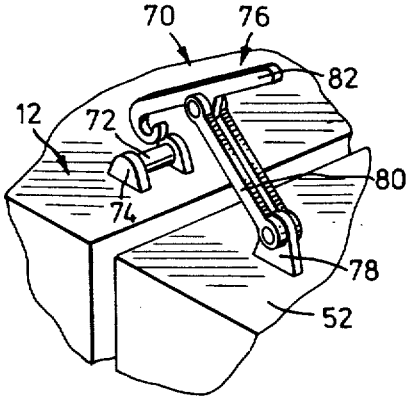
FIG. 4 is a pictorial view of the latching mechanism suitable for releasably securing the platform with respect to the stationary dock.
Figure 5:
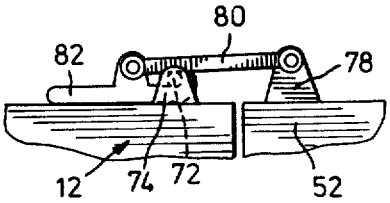
FIG. 5 is a side view of the latch of FIG. 4 in an opposite position.

Rail tracks 60 are laid on the deck 18 in alignment with rail tracks 62 on the stationary dock 52. A wheeled cradle 64 is mounted for movement along the rails 60 and is transferable from the rails 60 to the rails 62. The cradle 64 is designed to support the vessel 66 which is to be docked. In order to securely lock the platform 12 with respect to the stationary dock 52, a latching mechanism generally identified by the reference numeral 70 (FIG. 4) is provided. The latching mechanism includes a locking bar 72 which is supported on the platform 12 by support brackets 74 and a latching arm assembly 76 which is supported on the dock 52. The latching arm includes an anchor plate 78 mounted on the dock 52, a link arm 80 and a locking lever 82. The locking lever 82 has a hook-shaped end which extends over the bar 72 to the position shown in FIG. 5 of the drawings in order to secure the platform 12 against movement with respect to the dock 52.

In use, starting with the platform initially submerged in the position shown in broken lines in FIG. 1, a vessel is manoeuvered to a position above the platform. The vent valves 28 are, then, closed by remote manipulative system (not shown) and the buoyancy control system is operated by activating the pump 30 so that air is pumped through the conduit 32 and discharged through the nozzles 34 to bubble up through the body of water into the cavity 22. As the air accumulates in the cavity 32, the buoyancy of the platform 12 is increased and the platform begins to move upwardly along an arcuate path. The parallelogram link rods 40 serve to ensure that the platform remains horizontal as it is raised. Eventually, the cradle 64 engages the hull of the vessel 66 and continued introduction of air increases the buoyancy of the platform 12 to a sufficient extent to elevate the platform to the point where the link rods 40 are vertically oriented.

In this position, the front edge 48 of the platform is closely adjacent the front face 54 of the stationary dock. The latching mechanisms 70 are, then, employed to secure the platform with respect to the dock in a position where the support links 40 are inclined toward the stationary dock. It will be noted that in the released position shown in FIG. 4, the latch arm has a reach which is greater than the distance between the locking bar 72 and the support 78 when the latch mechansim is in the latched position shown in FIG. 5. Thus, the act of securing the latch arms serves to draw the platform forwardly toward the stationary dock positioning the link arms 40 over their top dead centre position so that they are inclined forwardly towards the dock in an angle of about 5°.

By reason of the fact that the parallelogram system is arranged over top, dead centre when the platform is in the position shown in FIG. 1 of the drawings, the loss of buoyancy of the platform would result in the movement of the platform to a position in which the front end thereof bears against the outside wall of the stationary dock, thereby preventing significant lowering of the platform.

When the platform is in the raised position, the wheeled cradle 64 with the vessel 66 mounted thereon may be towed from the platform onto the dock for servicing of the vessel or servicing may be carried out on the vessel when it is located on the platform.

Once the platform has been raised, the supply of air to the buoyancy chamber may be cut off or the rate of flow may be reduced to a minimal amount required to ensure that the platform retains its buoyancy.

From the foregoing, it will be seen that the energy required for raising the platform and its load is derived from changing the buoyancy of the platform. It will be understood that the capacity of the cavity determines the lifting capacity of the platform. Clearly, by increasing the volume of the buoyancy cavity, it is possible to increase the lifting capacity of the platform. The volume capacity of the buoyancy cavity may be increased by lengthening the skirt portion 20 or by increasing the area of the platform 18 or any combination thereof.

In order to launch a vessel, the vessel is located on the cradle 64 on the stationary dock 52. The platform is raised, as previously described, and the carriage with the vessel thereon is driven onto the platform. The latch mechanisms 70 are, then, released and the vent valves 28 are opened to permit air to escape from the cavity thereby permitting the platform to sink until the vessel is floated off of the cradle 64.

It will be noted that the platform has a sufficient weight to ensure that it will sink under its own weight when the vent valves 28 are opened to flood the buoyancy cavity.

Figure 3:
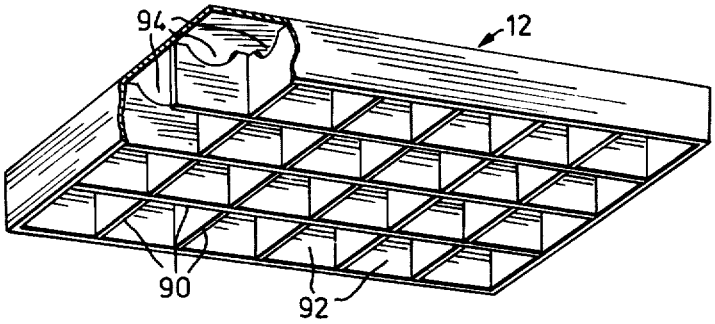
FIG. 3 is a pictorial view of the underside of a submersible platform.

As shown in FIG. 3 of the drawings, the buoyancy cavity may be subdivided by means of a plurality of divider walls 90 into a plurality of compartments 92. The compartments 92 may be isolated from one another or they may be interconnected by means of passages 94. The divider walls 90 serve to strengthen the platform and when isolated from one another serve to prevent a situation where flooding of the compartments adjacent the outer skirt would cause flooding of the compartment as a whole. In circumstances where compartments 92 are interconnected by passages 94, the air which is emitted from below is evenly distributed throughout the buoyancy compartment.

Figure 6:
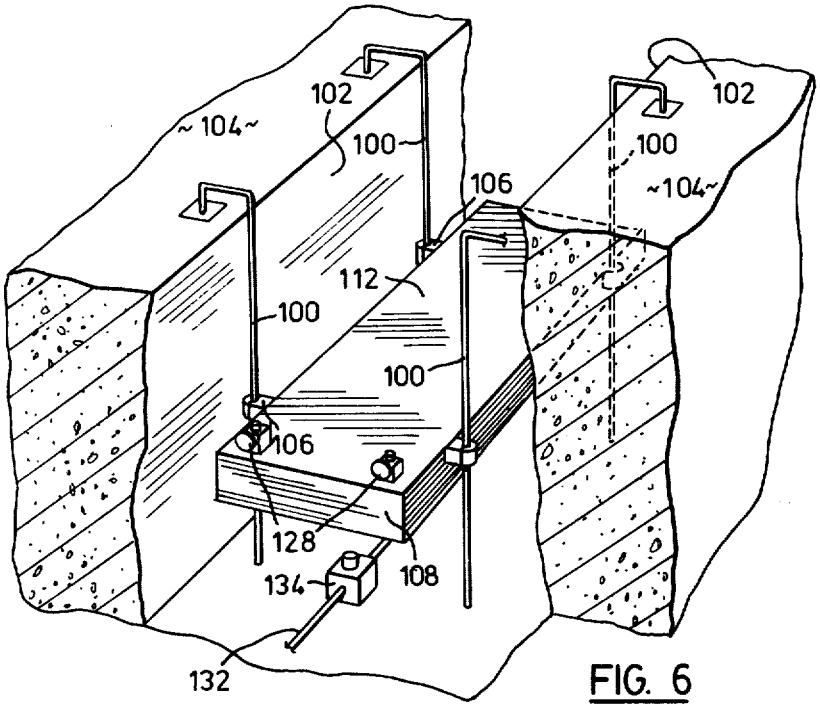
FIG. 6 is a pictorial view of a drydock system constructed in accordance with a further embodiment of the present invention.

The drydocking system illustrated in FIG. 6 of the drawings differs from that of the embodiments illustrated in FIGS. 1 and 2 of the drawings in that the guide means for guiding the platform is in a form of a plurality of parallel guide rails 100 which are located on oppositely disposed side faces 102 of stationary docks 104. Lugs 106 project laterally from the platform 108 to embrace a guide rail 100. Air is admitted to the buoyancy cavity (not shown) which is formed in the underside of the platform 112 from nozzles 134 which receive air from a compressed air source through conduit 132. Air is vented from the cavity through vent valves 128. Because the platform relies upon its buoyancy to obtain the required lifting action, it is necessary to provide stops at the upper end of the travel of the platform to ensure that the platform does not rise as the load is being removed from it. It is for this reason that the lugs 106 embrace the guide rails 100 and the upper ends of the guide rails 100 are hook-shaped to engage lugs 106 when the platform is in its uppermost position.

While the structure of FIG. 6 serves to illustrate the drydock which relies upon the buoyancy of the support platform for the purposes of raising and lowering a ship without the need to provide the parallelogram linkage system, it is to be noted that substantial advantages are derived from the use of the parallelogram linkage system. Included in these advantages are the fact that by reason of the fact that all of the links are of equal length and extend parallel to one another, the platform will always be retained by the links in a horizontal position. Furthermore, when the platform is fully elevated, the links will resist the buoyancy forces tending to further raise the platform when the load is removed. In addition, when the links are vertically oriented, they are capable of supporting the load even in circumstances where the buoyancy cavity is vented. Furthermore, when the platform is in the raised position with the legs vertically oriented, the buoyancy cavity can be partially or totally vented so that a portion or all of the load is carried by the support links. In tidal areas, it is important to ensure that the linkage mechanism is designed to permit supporting of the platform by the linkage arms when the platform is in a raised position so that the platform may be retained in the raised position when the tide falls. Alternatively, the platform may be permitted to float so as to rise and fall with the tide in which case the link arms serve to retain the platform in a horizontal position and do not function to support a compressive load, It will be noted that during the raising of the platform, the parallelogram support legs are subjected to relatively light, tensile loads and serve a function quite different to that of the parallel linkage system which had previously been proposed in docking systems in which the platform is mechanically hoisted within the support legs.

By reason of the fact that the platform and the parallel linkage guide means relies upon variations in buoyancy of the platform in order to effect raising and lowering of the platform, the components from which the platform links are fabricated may be of minimum weight because during the lifting action, they are not subjected to excessive loads. Because it is not necessary to provide pulleys and ropes for the purposes of raising and lowering the platform, the surrounding area can be made substantially of obstacles it being understood that the compressor and its related conduits can be spaced a substantial distance from the stationary dock area required to receive the ship which is being docked.

It will also be understood that a drydock constructed in accordance with the present invention can be used for stern or bow repairs to ships of considerably larger weight and overall dimension than those which correspond to the design parameters which permit smaller ships to be completely drydocked. In this application, the stern or bow of the ship can be supported on a pad or hinge on top of the lift platform and the stern or bow lifted out of the water by trimming. Semi-submersible drill rigs can also be trimmed for repair in a similar manner. By carefully proportioning the capacity of the buoyancy cavity, it is possible to ensure that the link rods and sea foundations are never subjected to excessive buoyancy forces which could tear the foundations loose from the sea bottom or break the link arms. This can be achieved by limiting the capacity of the buoyancy cavity.

In a further modification, the guidance means may be supplemented by cables or chains running from drums on a common shaft mounted on the stationary dock to each corner of the platform, the cables being arranged to move at the same speed at all times with the cable drums being designed to ensure that the cables remain taut. A breaking mechanism may be applied to this cable guidance system through which a breaking load may be applied to the lifting system so that the platform may be held at any required depth.

In yet another embodiment, the platform may be formed with a completely enclosed buoyancy chamber as opposed to an open-ended cavity. In this embodiment, the compressed air conduit may communicate directly with the buoyancy chamber and water may be pumped from or admitted to the chamber through seacocks.

These and other modifications of the present invention will be apparent to those skilled in the art.

What I claim as my invention is:

1. A drydock system comprising, (a) a shore-based stationary dock having an upper face and an outer side wall, (b) a submersible platform having an upper support face, a front end and an underside, said front end being disposed opposite said outer side wall of said shore-based stationary dock, a buoyancy cavity formed in said underside and opening downwardly therefrom, vent means adapted to open to vent said cavity and to close to make the cavity airtight, said platform being capable of submerging under its own weight when said vent means is open and said buoyancy cavity is flooded and being sufficiently buoyant to float and raise a vessel of a predetermined weight from the body of water when said vent means is closed and said cavity is filled with air, (c) foundation means underlying said platform and disposed adjacent said outer side wall of said stationary dock, (d) guide means for guiding said platform along a predetermined path extending in an arc from a raised position in which said front end of said platform is juxtaposed, said outer side wall of said stationary dock to a submerged position spaced outwardly from the stationay dock, said platform moving in a first direction when moving from said lowered position to said raised position and a second direction moving from said raised position to said lowered position, said guide means comprising a parallelogram linkage system interconnecting the platform and the foundation means, said parallelogram linkage system being arranged over top dead center in said first direction when said platform is in said raised position, whereby a loss of buoyancy in the platform would result in the movement of the platform to a position in which the front end thereof bears against the outside wall of the stationay dock thereby preventing significant lowering of the platform, (e) buoyancy control means communicating with said buoyancy chamber for varying the amount of air within said chamber to effect raising and lowering of said platform relative to said foundation means, (f) means for securing said platform against movement with respect to said shore-based stationary dock when said platform is in said raised position.

2. A drydock system as claimed in claim 1 further comprising a wheeled cradle mounted on the upper surface of the platform for receiving and supporting a vessel for movement therealong whereby a vessel may be transported between the stationary dock and the platform.

* * * * *